US006695542B2

(12) United States Patent
Strømberg et al.

(10) Patent No.: US 6,695,542 B2
(45) Date of Patent: Feb. 24, 2004

(54) RISER GUIDE

(75) Inventors: Håkon Strømberg, Oslo (NO); Tom Strandbakken, Fetsund (NO)

(73) Assignee: Moss Maritime AS, Lysaker (NO)

( * ) Notice: Subject to any disclaimer, the term of this patent is extended or adjusted under 35 U.S.C. 154(b) by 0 days.

(21) Appl. No.: 10/137,271

(22) Filed: May 3, 2002

(65) Prior Publication Data

US 2003/0206773 A1 Nov. 6, 2003

(51) Int. Cl.[7] ..... E21B 19/24; E21B 17/01

(52) U.S. Cl. ..... 405/224.2; 166/342; 166/341; 166/349; 166/367

(58) Field of Search ..... 405/224.2, 224.3, 405/224.4, 224, 223.1, 195.1; 166/342, 341, 340, 349, 350, 359, 367

(56) References Cited

U.S. PATENT DOCUMENTS 4,505,614 A * 3/1985 Anschutz ..... 405/195.1
4,512,409 A * 4/1985 Gregory et al. ..... 166/349
5,950,737 A * 9/1999 Chou et al. ..... 405/195.1
6,260,625 B1 * 7/2001 Phan et al. ..... 166/350

FOREIGN PATENT DOCUMENTS

WO WO 00/58598 10/2000

* cited by examiner

*Primary Examiner*—Frederick L. Lagman
(74) *Attorney, Agent, or Firm*—Birch, Stewart, Kolasch & Birch, LLP

(57) ABSTRACT

A riser guide is for use on a floating offshore platform, the platform comprises a topsides and a substructure having a lower pontoon, and at least one riser extends from a subsea location to the topsides. A number of riser guides are located in a guide housing which is secured to the platform. Each riser guide comprises a support arm rotatably mounted in the guide housing. A roller for laterally guiding the riser is rotatably mounted in an end of the support arm. A vertically movable wedge which is used for lifting the guide housing is connected to the support arm. During lifting of the guide housing the wedge lifts the support arm and the roller to an inactive position. When installing the riser guides, the guide housing and the riser guides are placed around the riser at the topsides, and lowered down in place by lifting gear connected to the wedges.

16 Claims, 13 Drawing Sheets

RISER GUIDE

FIELD OF THE INVENTION

The invention relates to a riser guide for use on a floating offshore platform. The platform comprises a topsides and a substructure having a lower pontoon, and at least one riser extends from a subsea location to the topsides.

The invention also relates to a method for installing riser guides on a floating offshore platform, and a method for removing riser guides on a floating offshore platform.

DESCRIPTION OF THE BACKGROUND ART

In offshore hydrocarbon production, hydrocarbons flow from a subterranean formation into a well, and up to the sea bed. From the sea bed the hydrocarbons flow to a platform via risers. Risers can also be used for water or gas injection, in order to maintain the pressure in the reservoir, or for supplying pressurised hydraulic oil and electric signals for energising and controlling subsea equipment which is used in the hydrocarbon production.

In shallow and medium depth waters fixed platforms resting on the sea bed are used. In deep seas a structure resting on the sea bed would be too large, and therefore floating platforms are used. Due to the motion of the sea, a floating platform is almost always moving. The risers may be stiff steel risers, which are prone to overstressing due to the motions of the floating platform. In order to overcome the problem of the moving platforms, flexible risers may be used. Flexible risers are, however, more expensive than stiff risers.

Irrespectively of what type of risers are used, they must to some extent be laterally guided. Typically riser guides will be located at the pontoon, The riser guides may include pads which are located close to or in abutment with the riser, for laterally guiding the riser during the movement of the platform.

WO 00/58598 discloses a riser guide system comprising a framework which is located around the riser and secured to the platform. Rollers, in the illustrated embodiment having a number of four, are located in the framework, close to or in abutment with the riser, for laterally guiding the riser.

Usually riser guides will be installed subsea, maybe at the pontoon 20–30 meter below the sea surface. This installation may be carried out by divers or an ROV (remote operated vehicle). This can be dangerous and problematic, and it is therefore desirable to find other ways to do this installation, without divers or an ROV.

Riser guides will after some time be worn, and they must therefore be replaced. Divers or an ROV may be used, but again this can be dangerous and problematic, and it is desirable to find other ways of replacing the riser guides.

BRIEF SUMMARY OF THE INVENTION

An object of the invention is to provide riser guides which can be installed and replaced from the topsides. A further object is to provide a method for installing riser guides on a floating offshore platform, and a method for removing riser guides on a floating offshore platform, which methods shall be carried out from the topsides. A particular object is that the invention shall be suitable for stiff risers.

The objects are achieved by a riser guide and methods according to the claims.

The invention thus relates to a riser guide for use on a floating offshore platform, the platform comprises a topsides and a substructure having a lower pontoon, at least one riser extends from a subsea location to the topsides, and a number of riser guides are located in a guide housing which is secured to the platform and have a through-going opening for the riser.

Each riser guide comprises a support arm essentially radially arranged in the guide housing, having an outer end facing away from the opening in the guide housing, the outer end of the support arm is rotatably mounted about a horizontal axis in the guide housing, and an inner end facing the riser, the inner end is tiltable between a lower and an upper position. The riser guide also comprises a roller rotatably mounted about a horizontal axis in the inner end of the support arm, the roller is tiltable between a lower position close to or in abutment with the riser, for laterally guiding the riser during movement of the platform in the sea, and an upper position away from the riser. Further the riser comprises a wedge provided with a connection for lifting gear, a mechanical link extends between the wedge and a connection on the support arm radially inwards from the horizontal axis of the support arm, the wedge is vertically movable between a lower position between the outer end of the support arm and the guide housing and an upper position above the support arm, in the upper position the wedge has lifted the inner end of the support arm with the roller to the upper position by means of the mechanical link.

When installing riser guides according to the invention on a floating offshore platform, the following steps are carried out:

a) placing a guide housing with a through-going opening around the riser at the topsides, a number of riser guides are located in the guide housing, b) connecting lifting gear to the wedges and tensioning the lifting gear, causing the rollers to move to their upper position, c) by means of the lifting gear lowering the guide housing into a primary guide secured to the platform, and d) slackening the lifting gear, thereby lowering the wedges and the rollers to their lower positions.

The lifting gear can be operated from the topsides, and the riser guides are thereby installed from the topsides.

When removing riser guides according to the invention on a floating offshore platform, the following steps are carried out:

a) tensioning the lifting gear, thereby lifting the wedges and the rollers to their upper positions, b) by means of the lifting gear lifting the guide housing out of the primary guide, c) lifting the guide housing up to the topsides, and d) removing the riser guides from the guide housing.

The lifting gear can be operated from the topsides, and the riser guides are thereby removed from the topsides. A guide housing with new or repaired rollers can then be installed as discussed above. A replacement of the riser guides from the topsides has thereby been carried out.

Further scope of the applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The invention will now be explained in closer detail with reference to the enclosed drawings, which are given by way of illustration only, and thus are not limitative of the present invention, and in which.

DETAILED DESCRIPTION OF THE INVENTION

Figure 1:
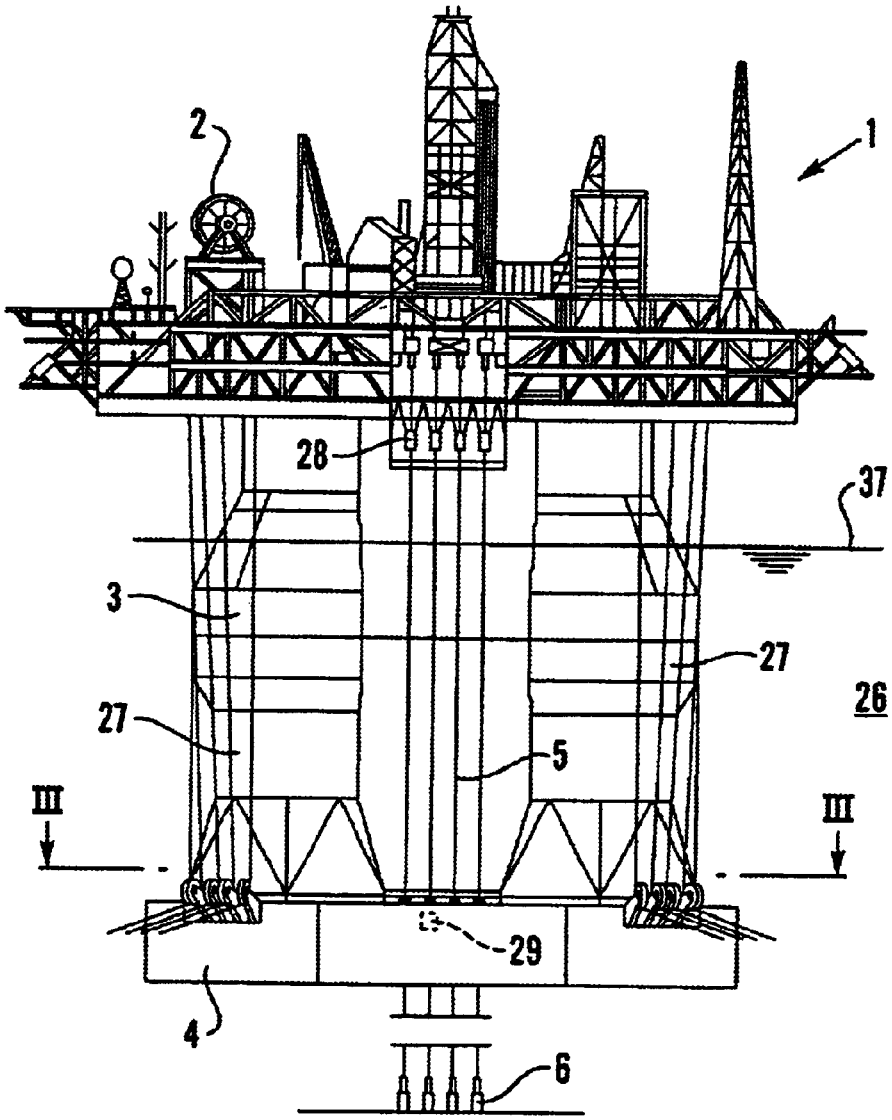
Fig. 1 Prior Art
FIG. 1 illustrates a floating platform in the sea.

FIG. 1 illustrates a floating offshore platform 1 in the sea 26. The waterline is designated by reference numeral 37. The platform comprises a topsides 2 and a substructure 3 having columns 27 and a lower pontoon 4. Several risers 5 (four are illustrated) extend from a subsea location 6 to the topsides 2. The subsea location is a manifold in which piping from several hydrocarbon-producing wells in a reservoir are interconnected. On the topsides 2 the risers 5 are terminated in Christmas-trees 28 containing various valves for controlling the production of hydrocarbons. Most of the risers are used for bringing hydrocarbons from the manifold to the topsides. One of the risers may be an umbilical, i.e. a riser containing piping for pressurised oil for energising valves in the manifold, and electric cables for controlling the valves. Other risers may be injection risers, for injecting pressurised water or gas in the reservoir in order to maintain the pressure in the reservoir.

Due to the motion of the sea, the platform 1 is almost always in motion. The illustrated risers 5 are stiff steel risers, and in order to avoid overstressing the risers during the motion of the sea, the risers 5 are guided by a riser guide system 29 located at the pontoon 4

The riser guide system comprises a permanent guide, a primary guide, a guide housing and riser guides according to the invention located in the guide housing.

Figure 2:
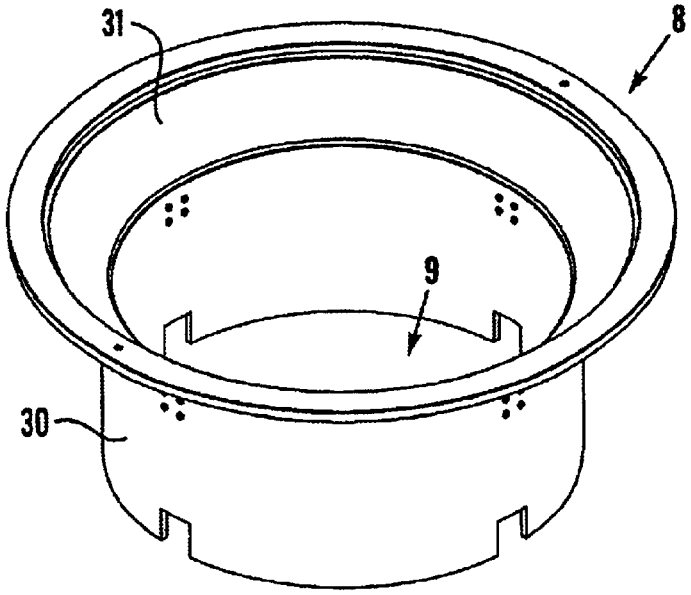
Fig.2 Prior Art
FIG. 2 illustrates a permanent guide.

FIG. 2 illustrates a permanent guide 8. The permanent guide 8 has the shape of a housing and consist of a lower cylindrical portion 30 and an upper frusto-conical portion 31, and have a through-going opening 9 for the riser 5 (not illustrated).

Figure 3:
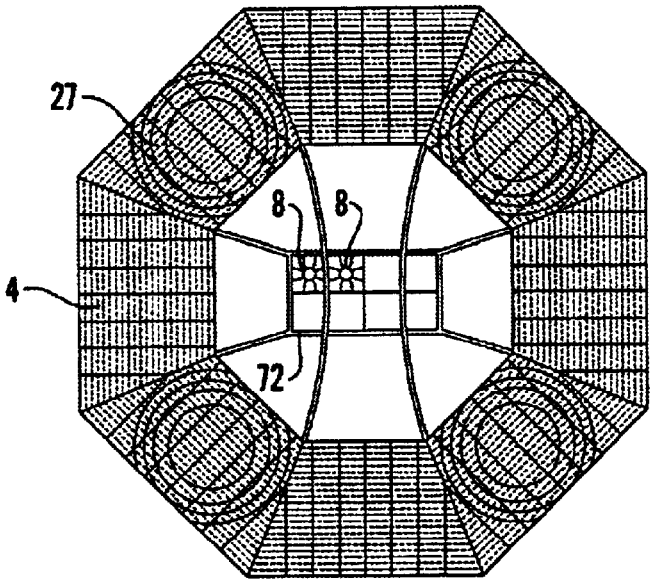
Fig.3 Prior Art
FIG. 3 illustrates the location of the permanent guide.

FIG. 3 is a sectional view taken through III—III in FIG. 1, and illustrates four columns 27, the pontoon 4 and two permanent guides 8 located in a trusswork 72 in the centre of the pontoon.

Figure 4:
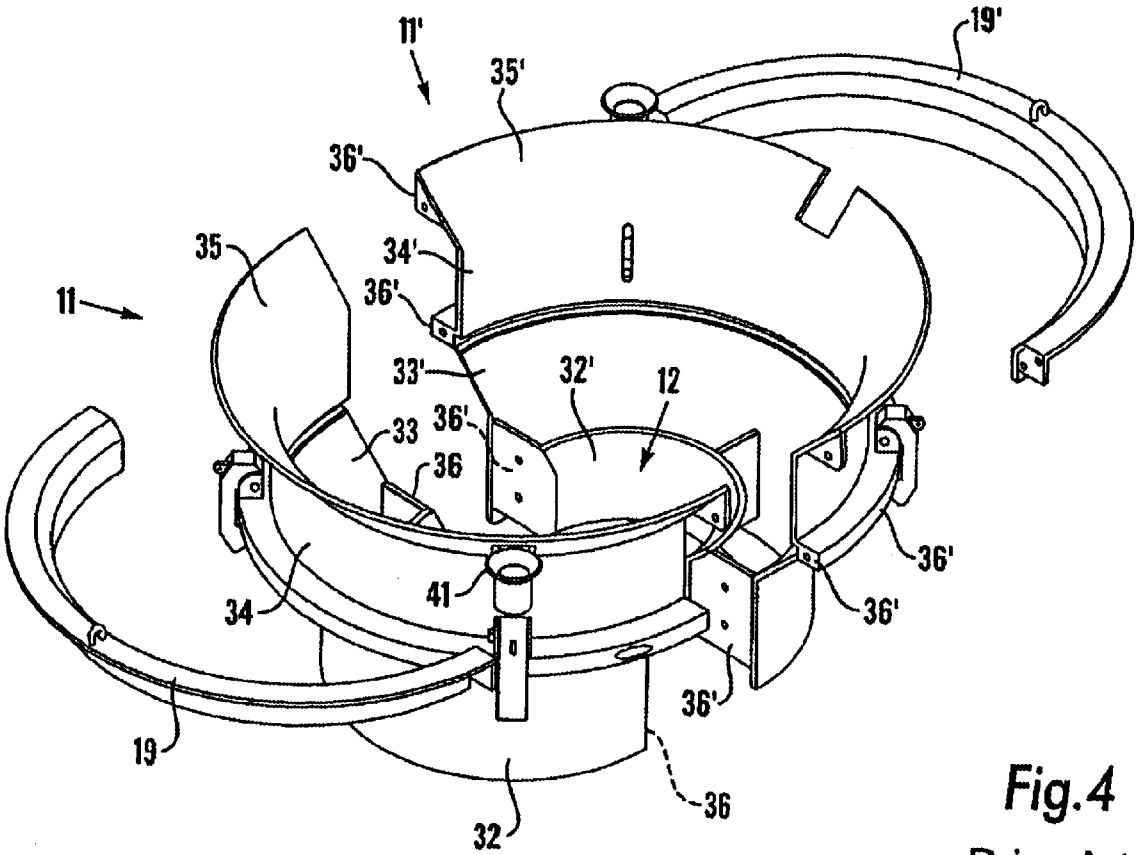
Fig.4 Prior Art
FIG. 4 illustrates a primary guide.

FIG. 4 illustrates a primary guide 11, 11', having the shape of a housing and having a through-going opening 12 for the riser 5 (not illustrated). The primary guide is longitudinally divided in two halves 11, 11' interconnectable by bolting. The interconnectability is achieved by flanges 36, 36' of the two halves 11, 11', and not illustrated bolting. Each half of the primary guide consists of a lower cylindrical portion 32, 32', a lower frusto-conical portion 33, 33', an upper cylindrical portion 34, 34' and an upper frusto-conical portion 35, 35'.

The dividing of the primary guide into two halves 11, 11' enables placing the primary guide around the riser 5 by placing the two halves 11, 11 ' facing each other with the riser in the opening 12, and then interconnect the two halves into the complete primary guide.

Figure 5:
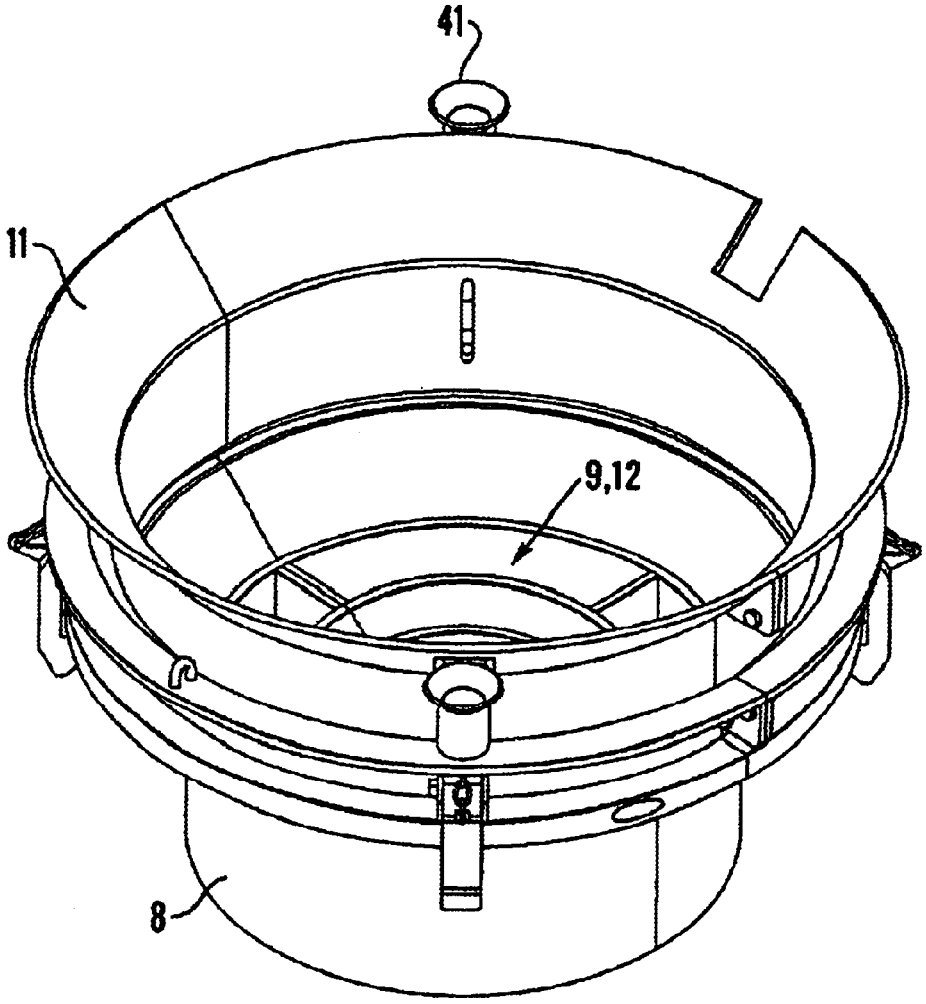
Fig.5 Prior Art
FIG. 5 illustrates the primary guide inside the permanent guide.

FIG. 5 illustrates the primary guide 11 located inside the permanent guide 8. The openings 9, 12 of the permanent guide and the primary guide are coaxial, for the through-going, not illustrated riser.

Figure 6:
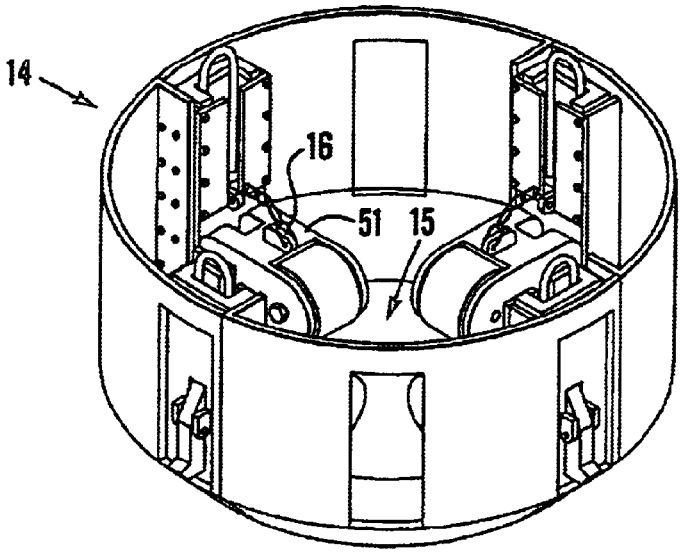
FIG. 6 illustrates a guide housing and riser guides according to the invention.

FIG. 6 illustrates a guide housing 14 according to the invention, having the shape of a cylindrical housing and having a through-going opening 15 for the riser 5. Four riser guides 16 are located in the guide housing 14.

Figure 7:
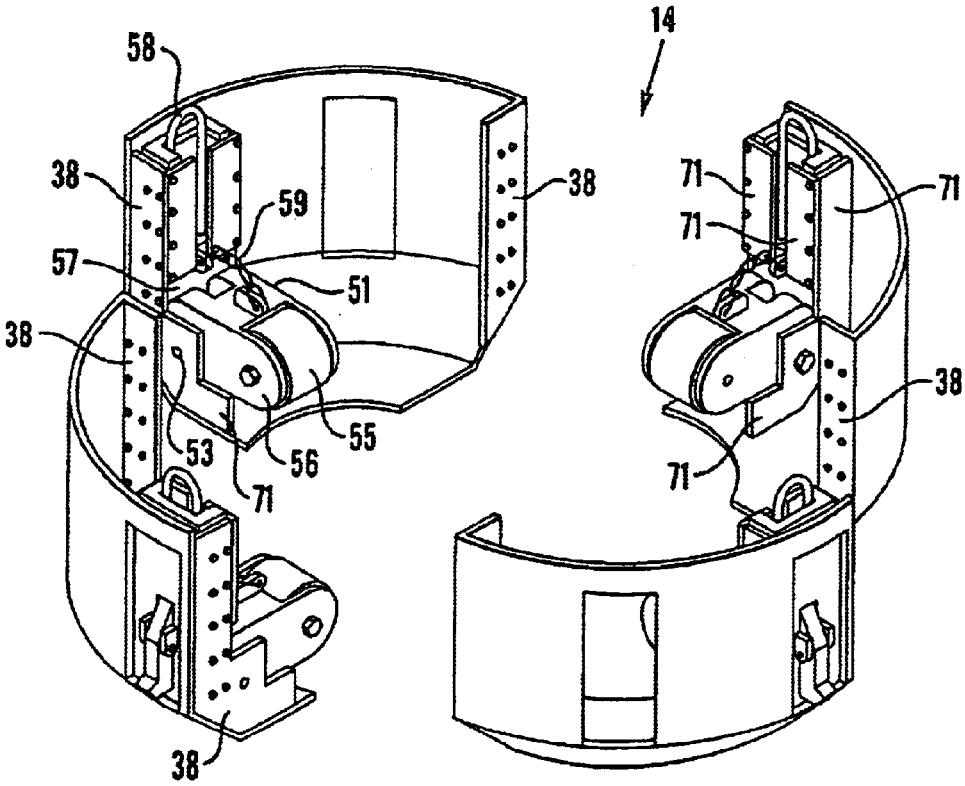
FIG. 7 illustrates the guide housing divided in four parts.

Like the primary guide, the guide housing 14 is preferably longitudinally divideable in two or more mechanically interconnectable parts, This is illustrated in FIG. 7, which illustrates the guide housing 14 divided in four parts. The four parts of the guide housing are interconnectable by means of flanges 38 and not illustrated bolting. For a description of the riser guides, reference is also made to FIGS. 11–15.

Each of the riser guides 16 comprise a support arm 51 essentially radially arranged in the guide housing 14. An outer end 52 of the support arm, i.e. the end of the support arm 51 pointing away from the centre of the riser guide 16 and the opening 15 in the guide housing 14, is rotatably mounted about a horizontal axis 53 in steel plates 71 integral with the guide housing 14. A roller 55 is rotatably mounted about a horizontal axis 56 in the inner end 54 of the support arm 51, "inner end" being understood as the end pointing towards the centre of the riser guide 16, i.e. pointing towards the riser 5. The support arm 51 and the roller 55 are held in place by bolting in the axes' 53, 56. The support arm 51 and the roller 55 are thereby tiltable between a lower illustrated position in which the roller 55 is close to or in abutment with the riser 5, for laterally guiding the riser 5 during movement of the platform 1 in the sea 26, and a not illustrated upper position away from the riser 5.

A wedge 57 is provided with a connection 58 for lifting gear 70, and a mechanical link 59 extends between the wedge 57 and a connection 60 on the support arm 51 radially inwards from the horizontal axis 53 of the support arm 51. The wedge 57 is slideable in a vertical track formed by steel plates 71 integral with the guide housing 14. The wedge 57 is vertically movable between an illustrated lower position between the outer end 52 of the support arm 51 and the guide housing 14 and an upper not illustrated position above the support arm 51. In the upper position the wedge 57 lifts the inner end 54 of the support arm 51 with the roller 55 to the upper position by means of the mechanical link 59.

In the illustrated embodiment the wedge's 57 connection 58 for lifting gear 70 is a lifting bail, the lifting gear 70 is a wire and the mechanical link 59 is a chain.

When the wire 70 is connected to the lifting bails 58 and tensioned, the wedges 57 are lifted to their upper position, causing the rollers 55 to move to their upper, inactive position away from the riser 5. Thus, when lifting or lowering the guide housing 14 by wires 70 connected to the lifting bails 58, the rollers 55 will be in their upper, inactive position. When the wires 70 are slackened, the rollers 55 will move to their lower, active position.

When guiding the riser 5, large forces have to be absorbed. In order to absorb the forces without affecting the rotatable mounting 53 and the steel plates 71 supporting the support arm 51, the rotatable mounting 53 of the outer end 52 of the support arm 51 preferably has a radial clearance allowing a radial movement of the support arm 51 when the support arm 51 is in its lower position. A lateral movement of the riser 5 in radial direction thereby forces the roller 55 and the support arm 51 outwards, in abutment with the wedge 57. The wedge 57 is in turn forced into abutment with the guide housing 14, and forces from the riser 5 are therefore radially transferred through the roller 55, through the support arm 51, through the wedge 57, through the guide housing 14, through the primary guide 11, through the permanent guide 8 and into the support structure supporting the permanent guide, essentially without affecting the rotatable mounting 53 of the support arm 51. This radial clearance of the rotatable mounting 53 can be achieved by elongated holes in the steel plates 71, having a length of e.g. twice the diameter of the holes, and a through-going bolt located in the centre of the roller 55.

Further, in order to ensure a proper abutment between the support arm 51 and the wedge 57, preferably the outer end 52 of the support arm 51 has an essentially flat surface which in the lower position of the support arm 51 is essentially vertical.

Figure 8:
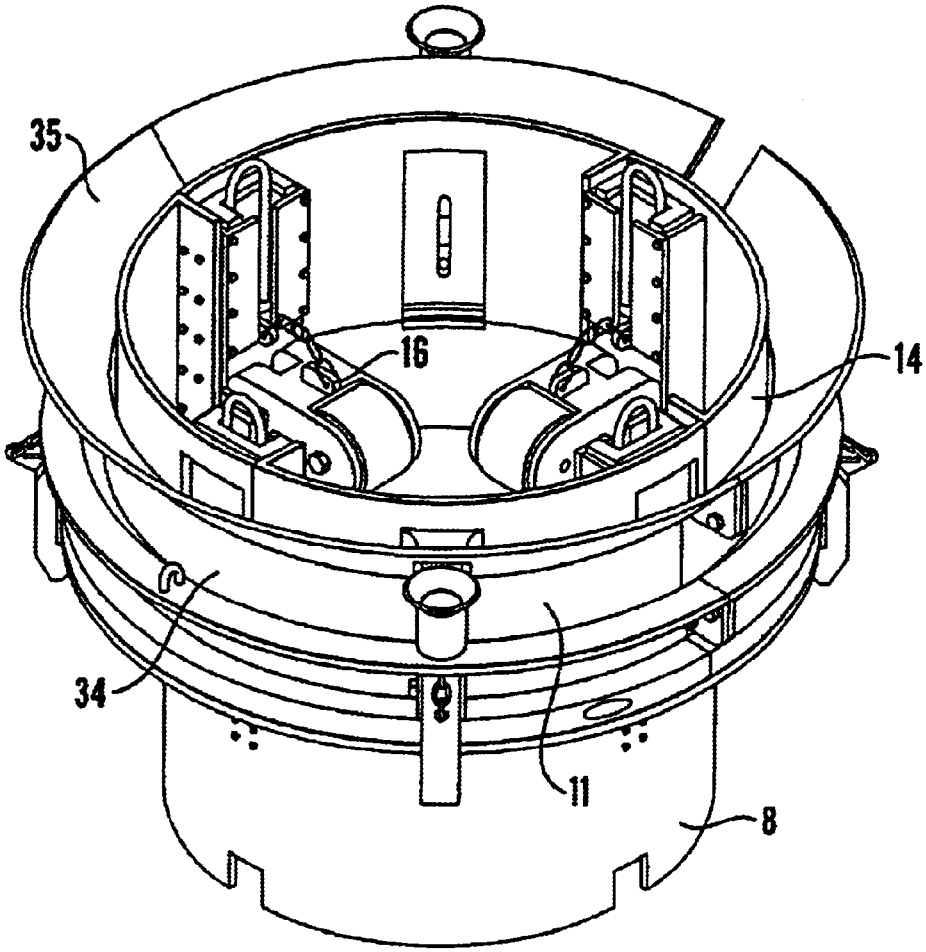
FIG. 8 illustrates a combination of the permanent guide, the primary guide and the guide housing.
Figure 9:
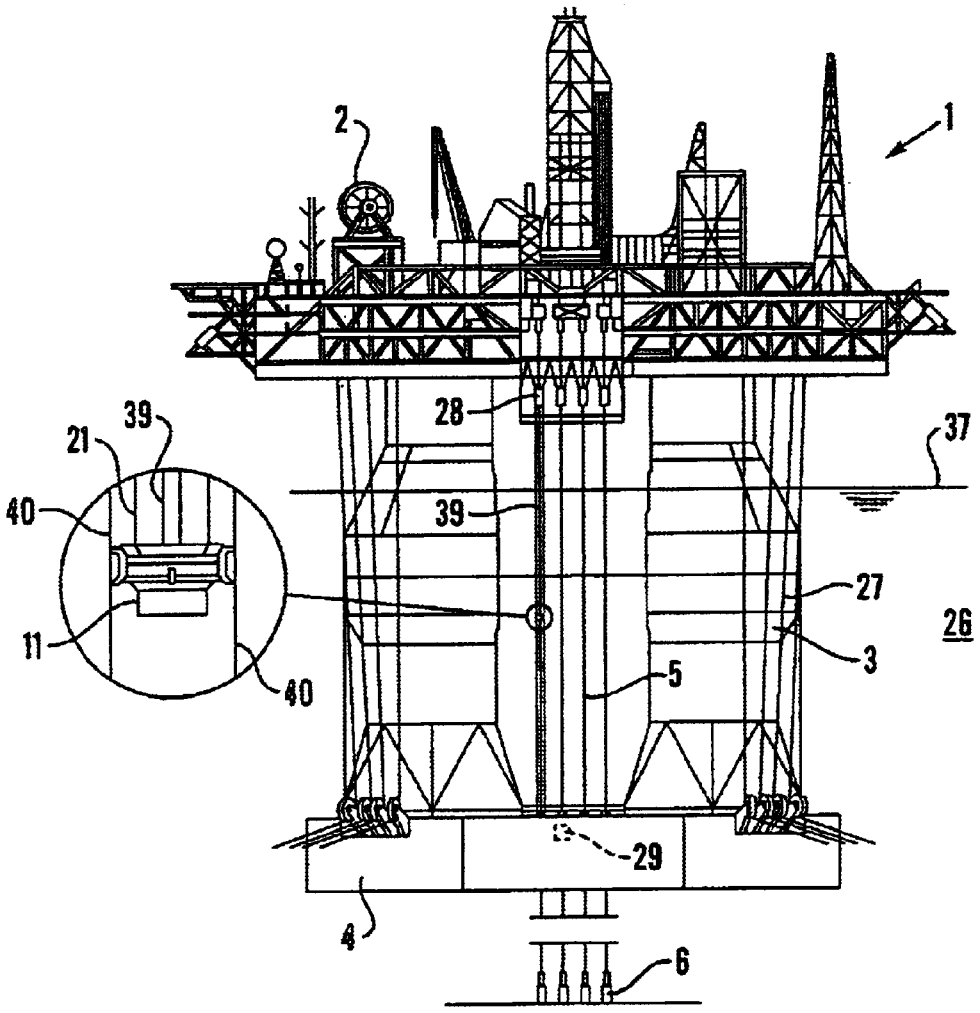
FIG. 9 illustrates lowering the primary guide from the topsides to the pontoon.

FIG. 8 illustrates a combination of the permanent guide 8, the primary guide 11 and the guide housing 14. The primary guide 11 is located in the permanent guide 8, and the guide housing 14 is located in the primary guide 11.

In the illustrations and discussion of this patent application the guide housing 14 is secured to an outer primary guide 11 which can be introduced into and removed from a permanent guide 8. The invention may, however, also be used together with a primary guide which is integral with or secured directly to the pontoon 4 or other part of the platform 1.

Further aspects of the invention will now be explained in connection with an explanation of the methods according to the invention.

Figure 10:
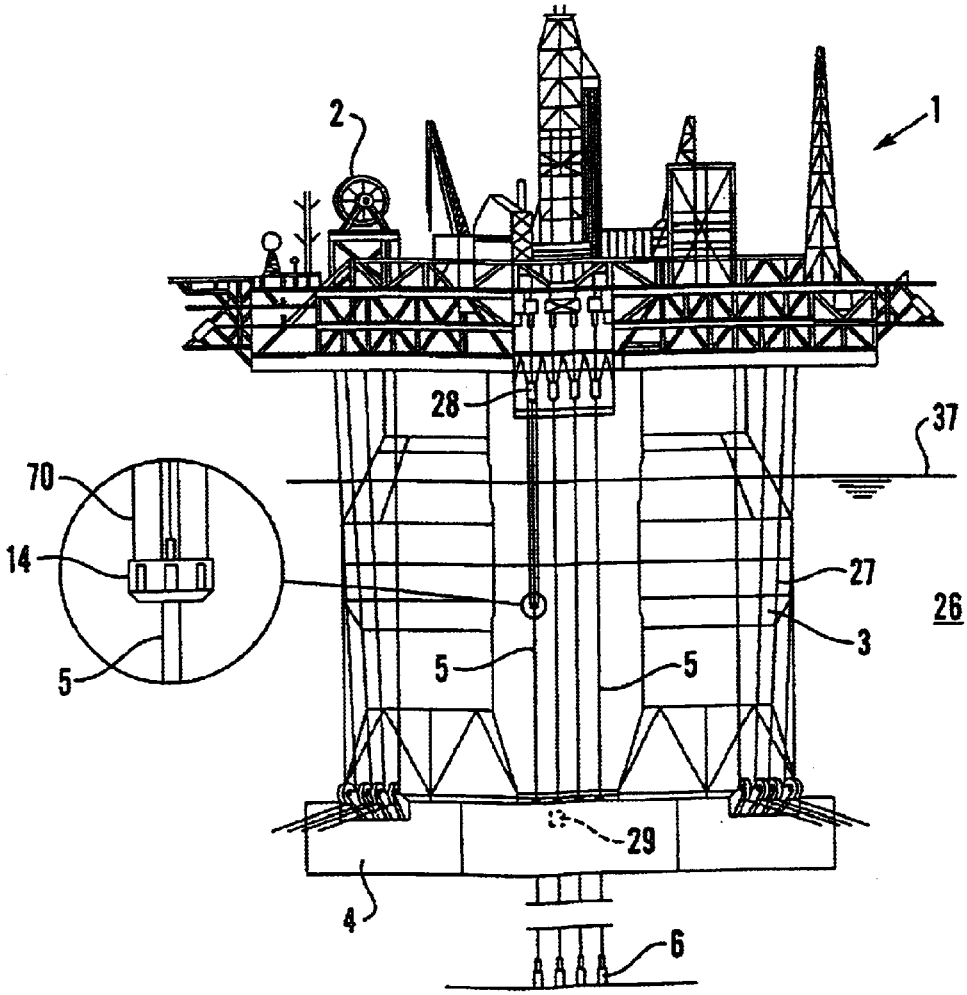
FIG. 10 illustrates lowering the guide housing from the topsides to the pontoon.

The invention relates to a method for installing riser guides 16 on a floating offshore platform 1. The method comprises the following steps:

a) Placing a guide housing 14 having a through-going opening 12 around the riser 5 at the topsides 2, a number of riser guides 16 are located in the guide housing 14. A guide housing in one piece may be used, in which case the riser 5 must be put through the opening 12 of the guide housing 14. Alternatively a guide housing which is longitudinally divideable in two or more interconnectable parts (see FIG. 7) may be used, which allows placing the parts around the riser 5 and interconnect the parts into the guide housing 14.

b) Connecting lifting gear 70 to the wedges 57 and tensioning the lifting gear 70, causing the rollers 55 to move to their upper position.

c) By means of the lifting gear 70 lowering the guide housing 14 into a primary guide 11 secured to the platform 1. The lowering is illustrated in FIG. 10, in which the lowering is carried out by lifting gear formed by wires 70. The guide housing 14 is sufficiently guided by the riser 5, and therefore no guidewires are required. The upper frusto-conical portion 35 of the primary guide 11 guides the guide housing 14 into the upper cylindrical portion 34 of the primary guide (see FIG. 8). Due to the tensioning of the lifting gear 70, the rollers 55 are in their upper, inactive position during the lowering.

d) Slackening the lifting gear 70, thereby lowering the wedges 57 and the rollers 55 to their lower, active positions in which they guide the riser 5.

Preferably, which will discussed in more detail later, the guide housing 14 is secured to the primary guide 11 by the lowering of the wedges 57 to their lower position.

The invention also relates to a method for removing riser guides 16 on a floating offshore platform 1. The method comprises the following steps:

a) Tensioning the lifting gear 70, thereby lifting the wedges 57 and the rolers 55 to their upper, inactive positions. Preferably the lifting of the wedges 57 also releases the guide housing 14 from the primary guide 11.

b) By means of the lifting gear 70 lifting the guide housing 14 out of the primary guide 11.

c) Lifting the guide housing 14 up to the topsides 2.

d) Removing the riser guides 16 from the guide housing 14. This can be done by un-tightening and removing bolting which hold the support arms 51 and the rollers 55 in place. Preferably, in order to obtain easy access to the support arms and the rollers, the guide housing 14 is first divided in parts, and these parts are removed from the riser 5, after the guide housing 14 has been lifted up to the topsides 2.

The invention also relates to a favourable mechanism for securing and releasing the guide housing to the primary guide, which is illustrated in FIGS. 11–15.

Figure 11:
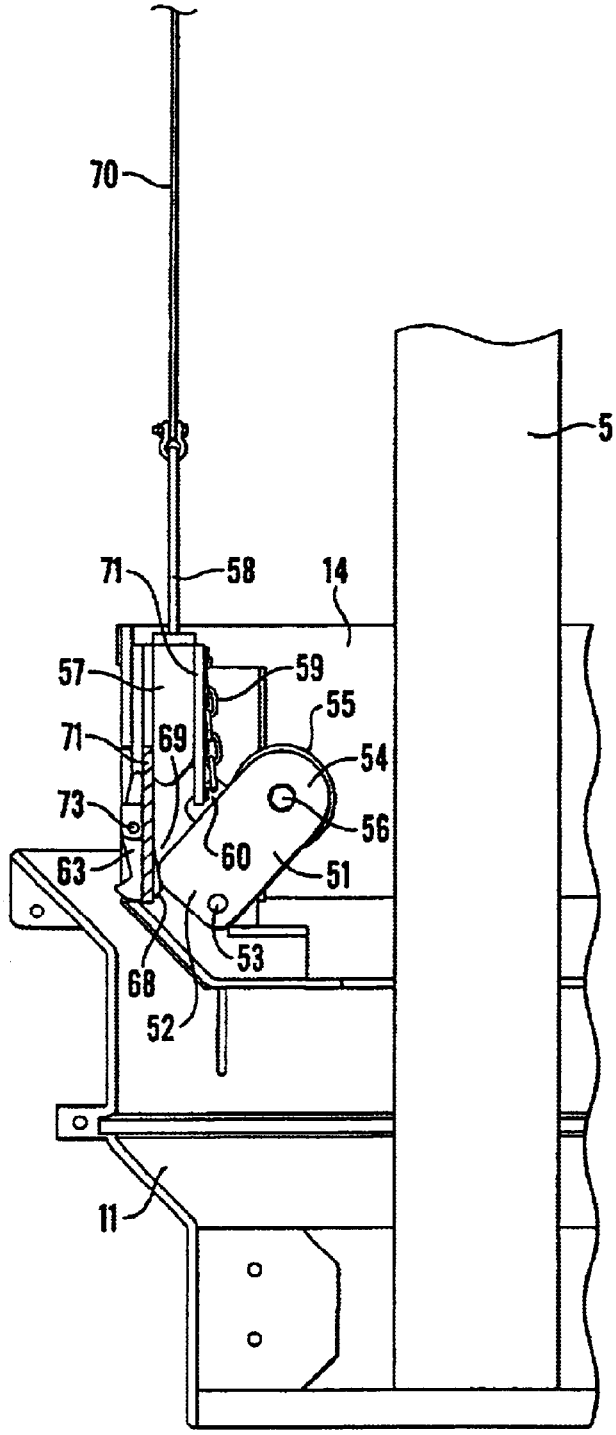
FIGS. 11–15 illustrate the riser guides according to the invention and the guide housing being lowered into the primary guide.

The illustrated riser guide 16 is provided with a hook 63 movably mounted in the guide housing 14, i.e. the hook 63 is rotatably mounted about an axis 73 in steel plates 71 integral with the guide housing 14 (See FIG. 11). The hook has a gripping portion 64 for engagement with a notch or a groove 65 in the primary guide 11, the gripping portion 64 and the groove 65 have coacting slanting surfaces 66, 67 which, if the hook 63 is located in the groove 65 and is subjected to a vertical upwards movement, force the gripping portion 64 out of the groove 65 and force a back portion 68 of the hook 63 into a space 69 between the support arm 51 and a steel plate 71 of the guide housing 14. In its lower position the wedge 57 prevents the hook's back portion 68 from projecting into the space 69, and the hook's gripping portion 64 is thereby locked in the groove 65 (see FIG. 15).

The riser guide 16 is thus provided with locking elements which in an engaged position secure the guide housing 14 to the primary guide 11, and in a free position allow the guide housing 14 to be removed from the primary guide 11.

FIGS. 11–15 illustrate a sequence of lowering the guide housing 14 into the primary guide 11.

In FIG. 11 the guide housing 14 is suspended from the wires 70 above the primary guide 11. The tension of the wires 70 holds both the wedge 57, the support arm 51 and the roller 55 in their upper position. The back portion 68 of the hook 63 is free to move into the space 69 between the support arm 51 and the steel plate 71 of the guide housing 14.

Figure 12:
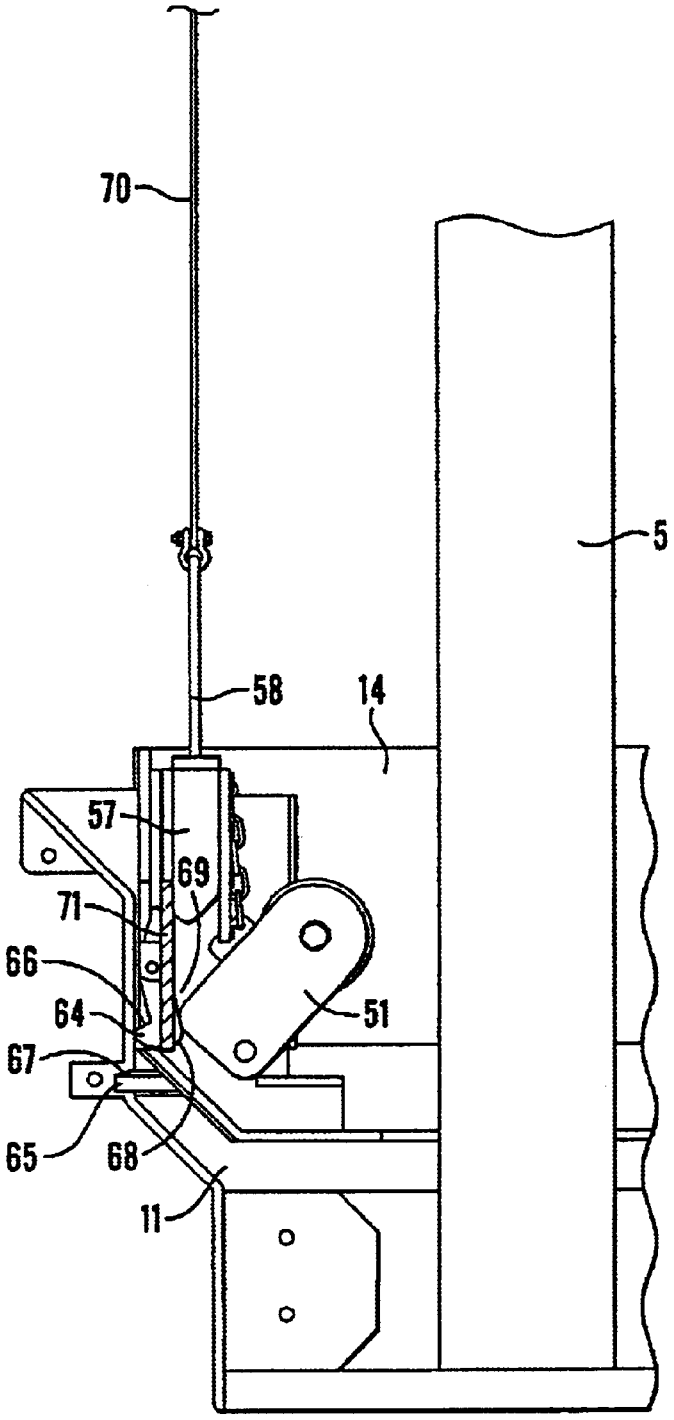

In FIG. 12 the guide housing 14 has been lowered partly down into the primary guide 11.

Figure 13:
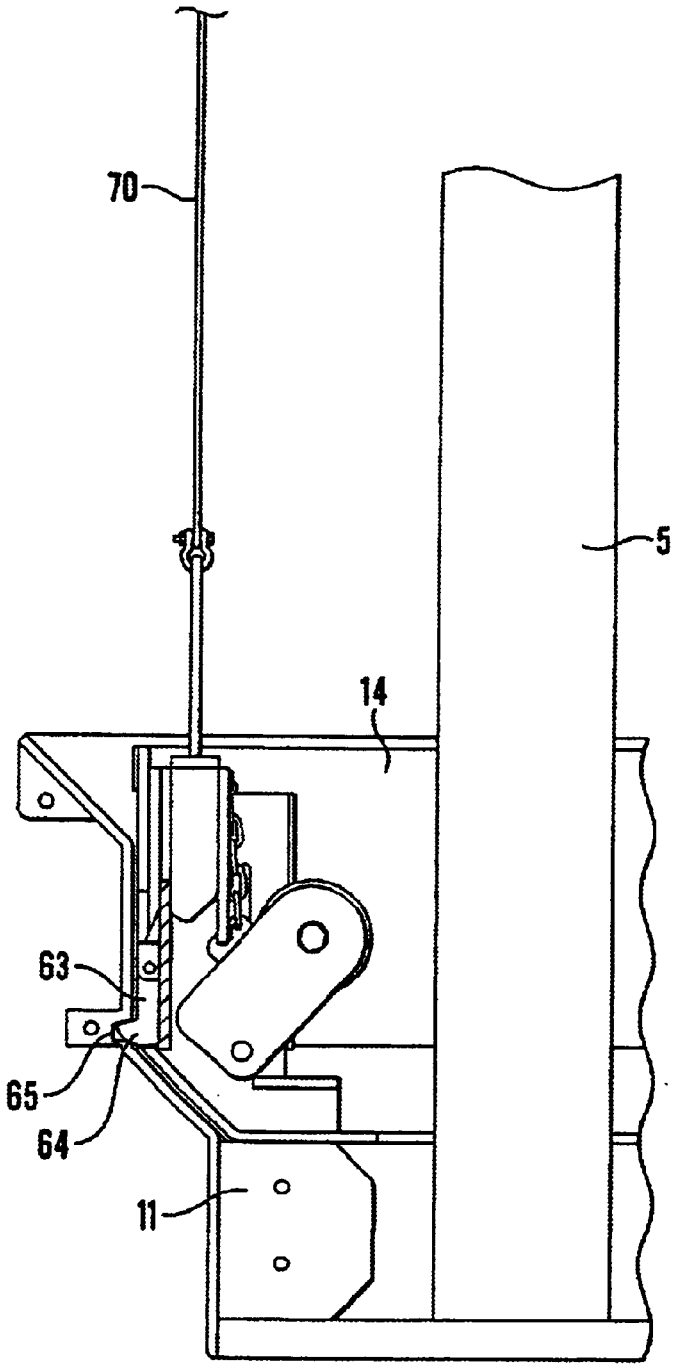

In FIG. 13 the guide housing 14 has been lowered completely down into the primary guide 11. The hook's gripping portion 64 has moved into the groove 65 in the primary guide 11, i.e. the hook 63 is engaged in the groove 65, but not yet locked in the groove 65. The wire 70 is still tensioned, and the wedge 57, the support arm 51 and the roller 55 are still in their upper position.

Figure 14:
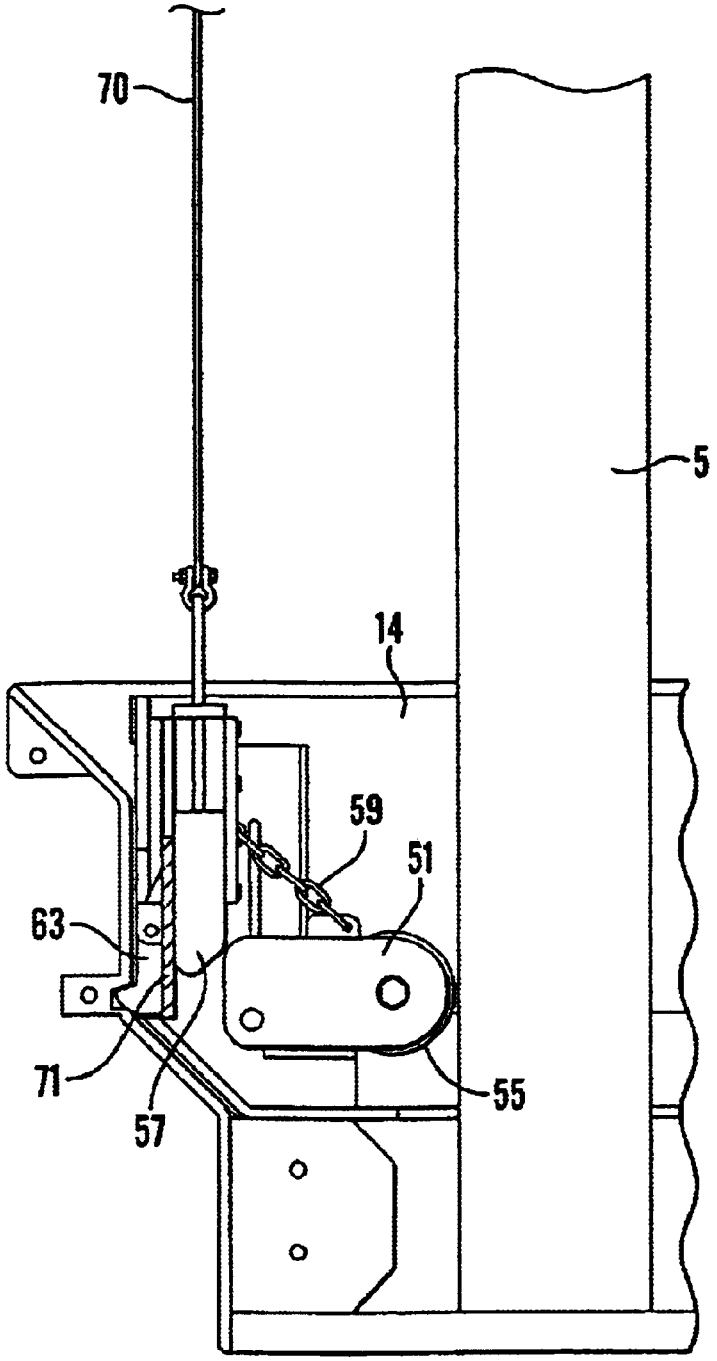

In FIG. 14 the wire 70 is about to be slackened. The wedge 57 have moved somewhat down, and the chain 59 has thereby let the support arm 51 and the roller 55 move to their lower position. The roller 55 now abuts the riser 5, but the roller is free to move to its upper position.

Figure 15:
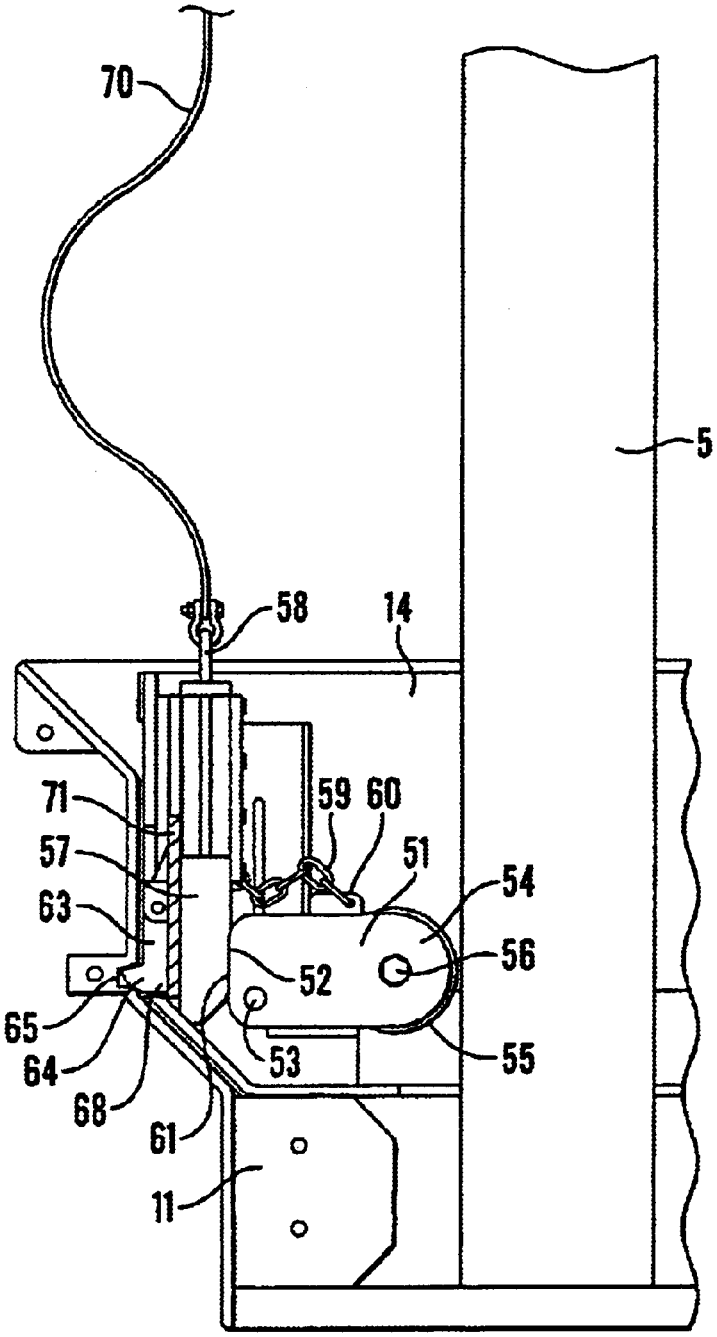

In FIG. 15 the wire 70 is slack. The wedge 57 has moved completely down to its lower position, in between the support arm 51 and the steel plate 71. The chain 59 is therefore slack. The outer end 52 of the support arm 51 has an essentially flat surface 61 which in the lower position of the support arm 51 is essentially vertical. This prevents the support arm 51 from rotating, and the wedge 57 thereby locks the support arm 51 in the lower position. As discussed, the wedge 57 also locks the hook 63 in engaged position.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A riser guide for use on a floating offshore platform, the platform comprises a topsides and a substructure having a lower pontoon, at least one riser extends from a subsea location to the topsides, a number of riser guides are located in a guide housing which is secured to the platform and have a through-going opening for the riser, wherein each riser guide comprises:

a support arm essentially radially arranged in the guide housing, having an outer end facing away from the opening in the guide housing, the outer end of the support arm is rotatably mounted about a horizontal axis in the guide housing, and an inner end facing the riser, the inner end is tiltable between a lower and an upper position, a roller rotatably mounted about a horizontal axis in the inner end of the support arm, the support arm with the roller is tiltable between a lower position close to or in abutment with the riser, for laterally guiding the riser during movement of the platform in the sea, and an upper position away from the riser, a wedge provided with a connection for lifting gear, a mechanical link extends between the wedge and a connection on the support arm radially inwards from the horizontal axis of the support arm, the wedge is vertically movable between a lower position between the outer end of the support arm and the guide housing and an upper position above the support arm, in the upper position the wedge has lifted the inner end of the support arm with the roller to the upper position by means of the mechanical link.

2. The riser guide of claim 1, wherein the rotatable mounting of the outer end of the support arm has a radial clearance allowing a radial movement of the support arm when the support arm is in the lower position, a lateral movement of the rise in radial direction thereby forces the roller and the support arm outwards, and forces from the riser are radially transferred through the roller, through the support arm, through the wedge and into the guide housing, essentially without affecting the rotatable mounting of the support arm.

3. The riser guide of claim 1, wherein the outer end of the support arm has an essentially flat surface which is in the lower position of the support arm is essentially vertical.

4. The riser guide of claim 1, wherein the wedge's connection for lifting gear is a lifting bail.

5. The riser guide of claim 1, wherein the wedge is slideable in a vertical track formed in the guide housing.

6. The riser guide of claim 1, wherein the mechanical link is an arm.

7. The riser guide of claim 1, wherein the guide housing is secured to an outer primary guide which is integral with or secured to the platform.

8. The riser guide of claim 7, comprising locking elements which in an engaged position secure the guide housing to the primary guide, and in a free position allow the guide housing to be removed from the primary guide, in its lower position the wedge holds the locking elements in their engaged position.

9. The riser guide of claim 8, wherein the locking elements comprise parts or portions which in the free position of the locking elements project into a space between the support arm and the guide housing, and in the engaged position of the locking elements are outside said space, in its lower position the wedge prevents said portions from projecting into said space, the wedge thereby locks the locking elements in engaged position.

10. The riser guide of claim 9, wherein the locking elements are formed by hooks movably mounted in the guide housing, having a gripping portion for engagement with a notch or a groove in the primary guide, the gripping portion and the groove have coacting slanting surfaces which, if the hook is subjected to a vertical upwards movement, force the gripping portion out of the groove and force a back portion of the book into the space between the support arm and the guide housing, in its lower position the wedge prevents the hook's back portion from projecting into said space, and the hook's gripping portion is thereby locked into the groove.

11. A method for installing riser guides on a floating offshore platform, the platform comprises a topsides and a substructure having a lower pontoon, at least one riser extends from a subsea location to the topsides, wherein the method comprises the following steps:

a) placing a guide housing with a through-going opening around the riser at the topsides, a number of riser guides are located in the guide housing, each riser guide comprises a support arm essentially radially arranged in the guide housing, having an outer end facing away from the opening in the guide housing, the outer end of the support arm is rotatably mounted about a horizontal axis in the guide housing, and an inner end facing the riser, the inner end is tiltable between a lower and an upper position, a roller rotatably mounted about a horizontal axis in the inner end of the support arm, the support arm with the roller is tiltable between a lower position close to or in abutment with the riser, for laterally guiding the riser during movement of the platform in the sea, and an upper position away from the riser, a wedge provided with a connection for lifting gear, a mechanical link extends between the wedge and a connection on the support arm radially inwards from the rotatable mounting of the support arm, the wedge is vertically movable between a lower position between the outer end of the support arm and the guide housing and an upper position above the support arm, in the upper position the wedge has lifted the inner end of the support arm with the roller to the upper position by means of the mechanical link, b) connecting lifting gear to the wedges and tensioning the lifting gear, causing the rollers to move to their upper positions, c) lowering the guide housing with the lifting gear into a primary guide secured to the platform, and d) slackening the lifting gear, thereby lowering the wedges and the rollers to their lower positions.

12. The method of claim 11, comprising a step of securing the guide housing to the primary guide by lowering the wedges to their lower position.

13. The method of claim 11, wherein placing the guide housing around the riser at the topsides comprises placing parts of a guide housing around the riser and mechanically interconnecting the parts, the parts thereby form the guide housing.

14. A method for removing riser guides on a floating offshore platform, the platform comprises a topsides and a substructure having a lower portion, at least one riser extends from a subsea location to the topsides, the riser guides are located in a housing which is secured to a primary guide secured to the platform, each riser guide comprises a support art essentially radially arranged in the guide housing, having an outer end facing away from the opening in the guide housing, the outer end of the support arm is rotatably mounted about a horizontal axis in the guide housing, and an inner end facing the riser, the inner end is tiltable between a lower and an upper position, a roller rotatably mounted about a horizontal axis in the inner end of the support arm, the support arm with the roller is tiltable between a lower position close to or in abutment with the riser, for laterally guiding the riser during movement of the platform in the sea, and an upper position away from the riser, a wedge connected to lifting gear, a mechanical link extends between the wedge and a connection on the support arm radially inwards from the horizontal axis of the support arm, the wedge is vertically movable between a lower position between the outer end of the support arm and the guide housing and an upper position above the support arm, in the upper position the wedge has lifted the inner end of the support arm with the roller to the upper position by means of the, mechanical link, the method comprises the following steps:

a) tensioning the lifting gear, thereby lifting the wedges and the rollers to their upper positions, b) lifting the guide housing with the lifting gear out of the primary guide, c) lifting the guide housing up to the topsides, and d) removing the riser guides from the guide housing.

15. The method of claim 14, comprising a step of releasing the guide housing from the primary guide by the lifting of the wedges from their lower to their upper positions.

16. The method of claim 14, comprising a step of dividing the guide housing into at least two parts and removing them from the riser after the guide housing has been lifted up to the topsides.

* * * * *